US008475650B2

(12) United States Patent
Wang et al.

(10) Patent No.: US 8,475,650 B2
(45) Date of Patent: Jul. 2, 2013

(54) PRE-PASSIVATION PROCESS FOR A CONTINUOUS REFORMING APPARATUS, AND PASSIVATION PROCESS FOR A CONTINUOUS REFORMING APPARATUS DURING THE INITIAL REACTION

(75) Inventors: Jieguang Wang, Beijing (CN); Aizeng Ma, Beijing (CN); Jianqiang Ren, Beijing (CN); Changqing Ji, Beijing (CN); Xinkuan Zhang, Beijing (CN); Hengfang Chen, Beijing (CN); Yajun Zhao, Beijing (CN)

(73) Assignees: China Petroleum & Chemical Corporation, Beijing (CN); Research Institute of Petroleum Processing, Sinopec, Beijing (CN)

( * ) Notice: Subject to any disclaimer, the term of this patent is extended or adjusted under 35 U.S.C. 154(b) by 512 days.

(21) Appl. No.: 12/740,458

(22) PCT Filed: Oct. 30, 2008

(86) PCT No.: PCT/CN2008/001819

§ 371 (c)(1),
(2), (4) Date: Jun. 10, 2010

(87) PCT Pub. No.: WO2009/067858

PCT Pub. Date: Jun. 4, 2009

(65) Prior Publication Data

US 2010/0282645 A1 Nov. 11, 2010

(30) Foreign Application Priority Data

Oct. 31, 2007 (CN) ..... 2007 1 0176571
Nov. 28, 2007 (CN) ..... 2007 1 0178229

(51) Int. Cl.
*C10G 9/16* (2006.01)

(52) U.S. Cl.
USPC ..... 208/133; 502/216; 502/219; 502/220; 502/221; 502/222; 502/223; 423/564

(58) Field of Classification Search
USPC ..... 208/48 R, 133–141; 502/216, 219–223; 423/564
See application file for complete search history.

(56) References Cited

U.S. PATENT DOCUMENTS 2,863,825 A 12/1958 Engel
3,999,961 A 12/1976 White et al.

(Continued)

FOREIGN PATENT DOCUMENTS

CA 962210 2/1975
CN 85106828 A 3/1987

(Continued)

OTHER PUBLICATIONS

Baokun, L., "Industrial Application of a Continuous Reforming Catalyst GCR-100" Petroleum Processing and Petrochemicals (Aug. 2002) pp. 26-29, vol. 33, No. 8, together with English-language abstract.

(Continued)

*Primary Examiner* — Brian McCaig
(74) *Attorney, Agent, or Firm* — Scully, Scott, Murphy & Presser, P.C.

(57) ABSTRACT

The present invention relates to a pre-passivation process for a continuous reforming apparatus prior to the reaction, or a passivation process for a continuous reforming apparatus during the initial reaction, comprising loading a reforming catalyst into the continuous reforming apparatus, starting the gas circulation and raising the temperature of a reactor, injecting sulfide into the gas at a reactor temperature ranging from 100-650° C., controlling the sulfur amount in the recycle gas within a range of $0.5\text{-}100\times10^{-6}$ L/L so as to passivate the apparatus.

22 Claims, 2 Drawing Sheets

U.S. PATENT DOCUMENTS

| | | | | |
|---|---|---|---|---|
| 4,159,938 | A | 7/1979 | Lewis | |
| 4,220,520 | A | 9/1980 | Carter et al. | |
| 5,200,059 | A * | 4/1993 | Bogdan et al. | 208/79 |
| 6,495,487 | B1 | 12/2002 | Bogdan | |
| 6,780,814 | B2 | 8/2004 | Ma et al. | |

FOREIGN PATENT DOCUMENTS

| | | | |
|---|---|---|---|
| CN | 1126607 | C | 11/2003 |
| CN | 1160435 | C | 8/2004 |
| CN | 1234455 | C | 1/2006 |

OTHER PUBLICATIONS

Lian, T. et al., "Commercial Application of PS-VI Continuous Reforming Catalyst" Industrial Catalysis (Sep. 2003) pp. 5-8, vol. 11, No. 9, together with English-language abstract.

Catalytic Reforming Process and Engineering, 1st Edition (Nov. 2006) China Petrochemical Press, pp. 522-534, as described in the specification on p. 2, line 20.

Catalytic Reforming, 1st Edition (Apr. 2004) China Petrochemical Press, pp. 200-202, as described in the specification on p. 3, line 16.

* cited by examiner

PRE-PASSIVATION PROCESS FOR A CONTINUOUS REFORMING APPARATUS, AND PASSIVATION PROCESS FOR A CONTINUOUS REFORMING APPARATUS DURING THE INITIAL REACTION

TECHNICAL FIELD

The present invention relates to a pre-passivation process for a continuous reforming apparatus, and a passivation process for a continuous reforming apparatus during the initial reaction. Specifically speaking, the present invention relates to a passivation process for a reaction apparatus before feeding and reaction of the continuous reforming apparatus, or during the initial reaction.

BACKGROUND OF THE INVENTION

Due to the features such as high liquid yield, high hydrogen yield and high aromatics yield and the like, the continuous regenerative catalytic reforming of naphtha drew extensive attention during the production of high-octane gasoline and aromatics. At present, the reforming catalysts used in the continuous reforming apparatus are a series of dual or multi-metal catalysts containing platinum-tin, and the platinum-tin catalyst is sensitive to sulfide as compared with the catalyst containing only platinum. Thus, to ensure the normal operation of the catalytic reforming units, the sulfur amount in the reforming feedstock should be strictly limited.

CN1234455C, U.S. Pat. No. 6,495,487B1 and U.S. Pat. No. 6,780,814B2 all disclose the requirements on the operating environment of a platinum-tin multi-metal reforming catalyst, and state that, during the normal operation of the continuous reforming reaction, the naphtha feedstock used for reforming is desulfurized via catalytic desulfurization and adsorption desulfurization to the minimum, and sulfur-free is optimal.

*Petroleum Processing and Petrochemicals* and *Industrial Catalysis* respectively introduce at pages 26-29, Vol. 33, No. 8, 2002 and at pages 5-8, Vol. 11, No. 9, 2003 the index requirements on controlling the impurity content of the reforming materials by using the platinum-tin series reforming catalyst while the continuous reforming is normally operated, wherein the sulfur amount is generally controlled to be not greater than 0.5 μg/g.

The continuous reforming has a relatively low operating pressure, a relatively high reaction temperature and a relatively low hydrogen/feedstock oil ratio, and the apparatus is easy to coke during the reaction. With the progress of the technology, the continuous reforming continuously develops in the direction of higher severity level, such as ultralow pressure, low hydrogen/feedstock oil ratio, low space velocity and the like, and the coking tendencies of the reactor and heating furnace tube also increase. Up to the present, the reactor walls of many sets of the continuous reforming apparatus have been coked. Coking will result in poor catalyst flow, impairment of the components in the reactor, or even shutdown of the apparatus, so as to do enormous economic losses to the refineries.

*Catalytic Reforming Process and Engineering* (1st Edition, 2006-11, China Petrochemical Press, p 522-534) analyzes the coking mechanism of the continuous reforming apparatus. In the reducing atmosphere, hydrocarbon molecules are adsorbed on the surface of the metal crystal grains of the reactor walls, and excessively dehydrogenated under the metal catalysis of the reactor walls to produce carbon atoms so as to dissolve into or penetrate into crystal grain or particle interstices. Due to charcoal deposition and growth, metal crystal grains are separated from the matrix, so as to produce fibrous carbon with iron particles at the top thereof. Such charcoal is notably different from the carbon deposit on the catalyst in that such charcoal has higher catalytic dehydrogenation and hydrogenolysis activities; the reaction continues at a high temperature as soon as it is produced; the generation rate continues to speed up, and the fibrous carbon continuously get longer, coarser and harder. The development of fibrous carbon generally undergoes several phases comprising soft carbon, soft bottom carbon and hard carbon. The longer the time for the formation thereof is, the more serious the consequences are. The initial stage of the coke formation in the apparatus may result in the blockage of the circulating system so that the normal circulation cannot be carried out. The severe coke formation will impair the inner components of the reactors, such as sectorial tube, central tube and the like. If the formed coke goes into the regeneration system, topical overtemperature of the charring zone in the regenerator and of the oxychlorination zone occur so as to burn out the inner components in the regenerator. The impairment of the inner components in the reactor and regenerator becomes more severe with the prolongation of the operation time.

In order to prevent the metal walls of the continuous reforming apparatus from catalytic coking, *Catalytic Reforming* (1st Edition, 2004-4, China Petrochemical Press, p 200-202) introduces that the currently well-known process comprises feeding organic sulfides into the reforming feedstocks during the normal reforming operation, controlling the sulfur amount of the reforming feedstocks to be 0.2-0.3 μg/g so as to inhibit the catalytic activity of the metal surfaces of the inner walls of the reactor and the heating furnace tube. However, *Catalytic Reforming* does not introduce feeding sulfides into the feedstocks when the feedstock oil is fed into the continuous reforming apparatus at a low temperature. A general option could involve feeding sulfides into the reaction system when the inlet of each reactor reaches to a temperature greater than 480-490° C.

Currently, on the basis of the requirements on the material balance, the hydrogen balance and the product of refineries, the continuous reforming operation will rapidly increase the reaction severity level after the feedstock oil is fed and when water in the gas is qualified. The sulfur amount in the reforming feedstock is controlled to be 0.2-0.5 μg/g. In particular, the newly-built apparatus firstly used is not sufficient to rapidly or adequately passivate the reactor walls and the heating furnace tube walls. After the above-mentioned passivation process is used in a significant part of the continuous reforming apparatus, coking of the reaction system still occurs during the operation. It thus becomes an important problem paid more attention to by the continuous reforming technician how to effectively inhibit the metal-catalyzed coking of the continuous reforming reactor walls and the heating furnace tube walls.

There are many processes for preventing hydrocarbons from coking at the high-temperature positions of the reactor in other fields of the petrochemical industry. CN1160435C discloses a method of inhibiting coke deposition in pyrolysis furnaces, comprising, before feeding the hydrocarbon feedstocks into the pyrolysis furnace, treating the pyrolysis furnace with a combination of sulfur- and phosphorus-containing compounds having a total sulfur to phosphorus atomic ratio of at least 5, adding a sufficient amount of sulfur-containing compounds into phosphorus-containing compounds so as to form a uniform and effective passivation layer on the surface of pyrolysis furnaces, thereby effectively inhibiting the coke deposition.

CN85106828A discloses a process for forming sulfide layer on the surface of metal parts and apparatus therefor, comprising laying the metal parts on the cathodic disk in the reaction chamber of the vacuum furnace, laying solid sulfur in the vacuum furnace, solid sulfur being vaporized by heating, gaseous sulfur bombarding the metal parts laid on the cathodic disk under the influence of an electric field to form sulfide layer on the surface thereof.

CN1126607C discloses a process for suppressing and relaxing generation and deposition of coke in high-temperature cracking of hydrocarbons, wherein, prior to feeding the cracking feedstocks, a pre-treating agent which is a mixture of one or several chosen from hydrogen sulfide, organosulfur compound, organophosphorus compound and organothiophosphorus compound, together with the water vapour are fed into the cracking apparatus to pre-treat the metal surface. Said process can passivate the metal surface of the cracking furnace so as to suppress and relax generation and deposition of coke during the cracking and subsequent treatment.

Since platinum-tin series continuous reforming catalysts are extremely sensitive to impurities and have high requirements on the environment, various substances involved in said processes all result in severe or irreversible poisoning of the reforming catalyst, thereby being not suitable for the catalytic reforming process.

SUMMARY OF THE INVENTION

The object of the present invention is to provide a pre-passivation process for a continuous reforming apparatus, or a passivation process for a continuous reforming apparatus during the initial reaction, which can effectively inhibit metal-catalyzed coking of the reactor walls and the heating furnace tube walls, thereby reducing the operation risk of the apparatus.

In the present invention, there are two passivation processes for the reforming apparatus, wherein one is the pre-passivation prior to the feeding of the reforming feedstocks into the apparatus, and the other is the passivation process during the initial reaction for the apparatus after the feedstock materials are fed into the apparatus.

The pre-passivation process for a continuous reforming apparatus provided in the present invention comprises loading a reforming catalyst into the continuous reforming apparatus, starting the gas circulation and raising the temperature of a reactor, injecting sulfide into the gas at a reactor temperature ranging from 100-650° C., controlling the sulfur amount in the recycle gas within a range of $0.5\text{-}100\times10^{-6}$ L/L so as to passivate the apparatus.

The pre-passivation process for a continuous reforming apparatus provided in the present invention comprises the following steps:

(1) loading a reforming catalyst into the continuous reforming apparatus, starting the gas circulation and raising the temperature of a reactor, feeding the reforming feedstock into the reaction system when the temperature of the reactor is increased to 300-460° C., introducing sulfide into the reaction system while or after the reforming feedstock is fed, controlling the ratio of the total sulfur amount introduced into the system to the reforming feedstock within the range of 0.5 μg/g-50 μg/g, reducing the content of sulfide introduced into the system when hydrogen sulfide concentration in the recycle gas reaches to 2.0 μL/L~30 μL/L; and (2) maintaining the reforming reactor at a temperature of 460-490° C., controlling the ratio of the total sulfur amount introduced into the system to the reforming feedstock within the range of 0.2 μg/g-0.5 μg/g, adjusting the amount of the reforming feedstock to the design value of the apparatus, increasing the reforming reaction temperature to 490-545° C. according to the requirements on the octane number of the liquid product, and letting the reforming apparatus run under normal operating conditions.

The pre-passivation process for the reforming apparatus above comprises, prior to feeding the reaction feedstocks into the continuous reforming apparatus, feeding sulfide into the reaction system at a certain temperature and under the condition of gaseous medium flow, passivating the walls of the high-temperature vessels and tubes in the reaction system of the continuous reforming apparatus by controlling the sulfur amount in the gas at a certain level, thereby effectively inhibiting the catalyzed coking of the metal walls of the apparatus.

The passivation process for the continuous reforming apparatus during the initial reaction comprises feeding more sulfide into the reaction system after the feedstock is fed during the initial reaction, then adjusting the intake amount of sulfide so as to normally running the apparatus under specified conditions The process of the present invention can effectively passivate the walls of the reaction apparatus prior to the reforming reaction or during the initial reaction and prevent the active metal-catalyzed walls from coking, so as to reduce the operation risk of the apparatus.

DETAILED DESCRIPTION OF THE INVENTION

Figure 1:
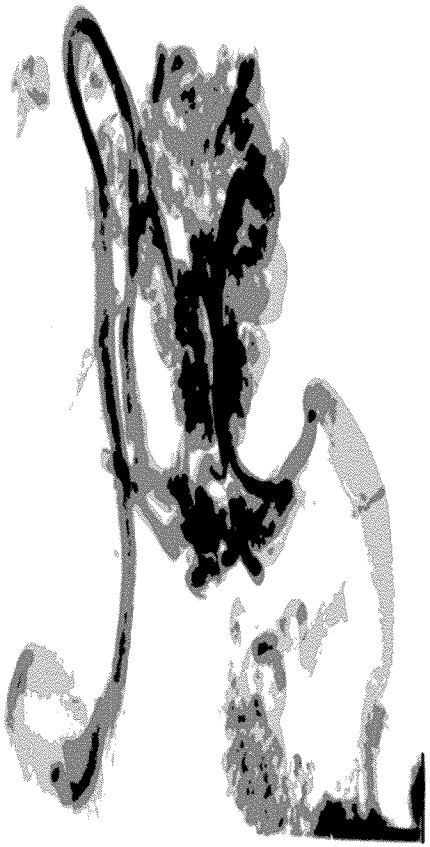
FIG. 1 and FIG. 2 are the electronic microscope photographs of carbon block collected in Comparative Example 1.

In one embodiment of the present invention, sulfide is added into the flow gas medium of the reaction system before the continuous reforming apparatus is filled with the catalyst and fed for the reaction. The walls of the high-temperature positions in the continuous regenerative reforming apparatus reactor and the heating furnace tube are sufficiently passivated, and the reaction apparatus is purged with the gas having no effect on the reaction, so as to enable the sulfur amount in the apparatus not to affect the reaction activity of the catalyst. Then the feedstocks are fed therein for reaction under the normal production conditions. In the process of the present invention, sulfide fed into the apparatus before the reforming reaction can inhibit the catalytic activity of metals on the walls at the high-temperature hydrogen exposure sites, prevent the catalytic coking resulted by the metal walls during the reaction and reduce the operation risks of the apparatus.

In the process of the present invention, sulfide is fed into the flowing gas of the system for pre-passivation of the walls before the feedstock is fed into the continuous reforming apparatus for reaction, wherein said recycle gas is generally the gas circulating in the system as the passivation medium. The recycle gas is preferably hydrogen gas, inert gas or a mixture of inert gas and hydrogen gas, wherein said inert gas is preferably nitrogen gas.

In said embodiment, the reforming reactor is firstly filled with the catalyst, wherein the pre-passivation temperature ranges from 100 to 650° C., preferably from 100 to 450° C., more preferably from 150 to 300° C. A gas circulation is built up in the system and enables the reactor to be heated. When the inlet temperature reaches 120-260° C., sulfides are injected. When the temperature of the reactor inlet increases to 370-420° C., such temperature is maintained for 1-50 h, preferably for 2-10 h. During the pre-passivation, the sulfur amount in the gas of the reaction apparatus is controlled to be $0.5\text{-}100\times10^{-6}$ L/L, preferably $2\text{-}20\times10^{-6}$ L/L, more preferably $3\text{-}20\times10^{-6}$ L/L, most preferably $3\text{-}6\times10^{-6}$ L/L. After the pre-passivation, the purge gas having no effect on the subsequent reforming reaction is fed to replace the gas in the apparatus. When sulfur amount in the vent gas is not greater than $5.0\times10^{-6}$ L/L, preferably $2.0\times10^{-6}$ L/L, the feedstock is fed and the reforming unit runs under the conventional reaction conditions. Preferably, the purge gas for replacing the initial recycle gas in the apparatus is hydrogen gas, inert gas or a mixture of inert gas and hydrogen gas, preferably hydrogen gas or nitrogen gas.

The conventional reaction conditions for the continuous reforming apparatus in said embodiment include a pressure of 0.1-5.0 MPa, preferably 0.35-2.0 MPa, a temperature of 350~600° C., preferably 430-560° C., more preferably 490-545° C., a hydrogen/hydrocarbon molar ratio of 1-20, preferably 2-10, a liquid hourly space velocity of 1-10 $hr^{-1}$, preferably 1-5 $hr^{-1}$.

The sulfide injected into the recycle gas is preferably hydrogen sulfide, carbon bisulfide, dimethyl disulfide, a sulfur-containing aliphatic compound, a sulfur-containing alicyclic compound, a sulfur-containing aromatic compound, a thiophene compound, a morpholine compound or a mixture of two or more of said compounds, wherein said thiophene compound or morpholine compound is the derivative of thiophene or morpholine. When inert gas, preferably nitrogen gas, is used as the medium for passivation, sulfide injected therein is preferably hydrogen sulfide; when hydrogen gas is used as the medium for passivation, sulfide injected therein may be hydrogen sulfide, or said organic sulfide.

In another embodiment of the present invention, the feedstock is introduced into the continuous reforming reaction system at low temperature during the initial stage of the reaction. During the heating, thermostatic dehydration and operation adjustment of the reaction system, a certain amount of sulfides is introduced into the reaction system so as to enable the sulfur amount in the system to reach to a higher level, i.e. controlling the ratio of the total sulfur amount introduced into the system to the reforming feedstock to be 0.5 μg/g-50 μg/g. When the concentration of hydrogen sulfide in the recycle gas reaches to a certain value, the sulfur amount in the system is re-reduced; after the water content in the system is qualified, the reaction temperature is increased for the normal production operation of the apparatus. Sulfide may be introduced into the reaction system in the manner of adding sulfide into the reforming feedstock, adding hydrogen sulfide or a hydrogen sulfide-containing gas into the recycle gas, or adding hydrogen sulfide or a hydrogen sulfide-containing gas into the recycle gas while adding sulfide into the reforming feedstock. Said hydrogen sulfide-containing gas is the hydrogen gas from the reforming pre-hydrotreating system, or other hydrogen-containing gases containing hydrogen sulfide in higher concentration, wherein hydrogen sulfide concentration in the hydrogen-containing gas is 50-5000 μL/L, preferably 100-2000 μL/L, more preferably 200-800 μL/L. The above-mentioned process can sufficiently and rapidly passivate the continuous reforming reactor walls and the heating furnace tube walls so as to inhibit coking. Higher sulfur amount during the initial stage of the reaction will not affect the progress adjustment of the apparatus operation, or the reaction activity of the catalyst during the operation of the continuous reforming apparatus under the condition of high severity level.

In said embodiment, step (1) involves injecting sulfur at low temperature after the apparatus is operated, introducing sulfide at low temperature while or after the feedstock is fed into the apparatus, preferably controlling the ratio of the total sulfur amount introduced into the system to the reforming feedstock to be 0.6-20 μg/g, more preferably 1.0-10 μg/g. After the introduction of sulfur in step (1), the hydrogen sulfide content in the recycle gas of the reforming apparatus should be detected regularly. When the concentration of hydrogen sulfide in the recycle gas reaches to more than 2.0-30 μL/L, preferably 2.0-6.0 μL/L, the total content of sulfide introduced into the system is reduced. Preferably, the ratio of the total sulfur amount introduced into the system to the reforming feedstock is reduced to 0.2-0.5 μg/g.

After the total sulfur amount introduced into the reaction system in step (1) is reduced, the regeneration system may be initiated for the cyclic regeneration of the catalyst according to the carbon deposit of the catalyst when the ratio of the total sulfur amount to the reforming feedstock is reduced to 0.2-2.0 μg/g, preferably 0.3-1.0 μg/g, and the hydrogen sulfide in the recycle gas is in a concentration of less than 5.0 μL/L, preferably 0.2-2.0 μL/L.

The sulfide introduced in step (1) is hydrogen sulfide, carbon bisulfide, dimethyl disulfide, a sulfur-containing aliphatic compound, a sulfur-containing alicyclic compound, a sulfur-containing aromatic compound, a thiophene compound, a morpholine compound or a mixture of two or more of said compounds, wherein said thiophene compound or morpholine compound is the derivative of thiophene or morpholine. Hydrogen sulfide, thioether or carbon bisulfide is preferred, wherein said thioether is preferably dimethyl disulfide or dimethyl sulfide.

In order to maintain the acid function of the reforming catalyst, chloride should also be introduced into the reforming system while sulfide is introduced therein. The injected chlorine content may be carried out according to the normal chlorine injecting requirements. Generally, when the water content in the circulating hydrogen is greater than 500 μL/L, the injected chlorine content is 30-50 μg/g; when the water content in the circulating hydrogen is 300-500 μL/L, the injected chlorine content is 15-30 μg/g; when the water content in the circulating hydrogen is 100-200 μL/L, the injected chlorine content is 5-10 μg/g; when the water content in the circulating hydrogen is 50-100 μL/L, the injected chlorine content is 2-5 μg/g. Chlorides to be fed are preferably halogenated hydrocarbons or halogenated olefins, e.g. dichloroethane, trichloroethane, tetrachloroethylene or carbon tetrachloride.

Step (2) of said embodiment concerns a thermostatic control system maintaining a relatively low amount of the sulfide introduced into the reaction system. The ratio of the total sulfur amount introduced into the system to the reforming feedstock is controlled to be 0.2-0.5 μg/g. After the water content in the recycle gas is reduced to the specified value, the reaction temperature is increased to the required reforming reaction temperature. The preferred operation comprises increasing the reaction temperature to 460-490° C. when the water content in the recycle gas is lower than 200 μL/L, and continuing to drain at such temperature; feeding the reforming feedstock according to the design amount when the water content in the recycle gas is lower than 50 μL/L, and increasing the reforming reaction temperature according to the requirements on the liquid product octane number generally to 490-545° C. so as to carry out the normal reforming reaction operation. During the operation, the reforming reaction pressure is controlled to be 0.1-5.0 MPa, preferably 0.35-2.0 MPa, the hydrogen/feedstock molar ratio is 1-20, preferably 2-10; the liquid hourly space velocity of the feedstock is 1-10 $hr^{-1}$, preferably 1-5 $hr^{-1}$.

In step (1) of said embodiment, the reforming feedstock is generally fed in an amount lower than the designed feed rate of the apparatus, preferably 50-75 mass % of the designed feed rate of the apparatus. After step (1) is finished, the reforming feedstock is further fed in step (2) according to the designed feed rate of the reforming apparatus to carry out the normal reforming reaction.

After the feedstock is fed, said recycle gas in said embodiment represents the gas, primarily hydrogen, circulating back to the reaction system after the gas-liquid separation. The recycle gas before feeding represents the gas circulating in the system, preferably hydrogen, inert gas or a mixture of hydrogen with inert gas, wherein said inert gas is preferably nitrogen gas.

In the above-mentioned process of the present invention, the reforming catalyst filled into the reaction system is preferably a series of dual or multi-metal reforming catalysts containing platinum-tin. Preferably, the reforming catalyst comprises a support, 0.01-2.0 mass %, preferably 0.1-1.0 mass % of a platinum-group metal relative to the dry basis support, 0.01-5.0 mass %, preferably 0.1-2.0 mass % of tin and 0.1-10 mass %, preferably 0.1-5.0 mass % of halogen, wherein said platinum-group metal is selected from the group consisting of platinum, rhodium, palladium, iridium, ruthenium and osmium, preferably platinum; halogen is preferably chlorine; said support is preferably alumina, more preferably γ-alumina. In addition, the reforming catalyst may further comprise a third and/or a fourth metal component selected from the group consisting of europium, cerium and titanium for improving the reaction activity of the catalyst, in an amount of 0.01-5.0 mass %, preferably 0.05-3.0 mass %, more preferably 0.1-2.0 mass %.

The continuous reforming apparatus of the process in the present invention are various moving-bed continuous regenerative catalytic reforming apparatus. The feedstocks to be continuously reformed may be straight-run naphtha, hydrocracking heavy naphtha, hydrogen-carbonizing gasoline, raffinate oil of ethylene-cracking gasoline, catalytic cracking gasoline, or the mixture of several feedstocks above. According to different target products, the distillation ranges controlled by the feedstock are also different. The initial boiling point of the feedstock generally ranges from 60 to 95° C., and the final boiling point generally ranges from 135 to 180° C. The requirements on the impurities in the reforming feedstock are as follows: sulfur<0.5 μg/g, nitrogen<0.5 μg/g, arsenic<1 ng/g, lead<10 ng/g, copper<10 ng/g, and water<5 μg/g.

The passivation process for the reforming apparatus in the present invention is suitable for the continuous regenerative reforming apparatus for platinum-tin series catalysts, in particular for the first application process of the newly-built continuous reforming apparatus.

The following examples are used to further illuminate the present invention, but the present invention is not limited to the following examples.

Example 1

The reforming catalyst was loaded into the continuous reforming apparatus, wherein the catalyst comprised 0.29 mass % of platinum, 0.31 mass % of tin, and the remaining being γ-alumina.

Nitrogen gas having a purity of 99.8 mol % was used to purge the apparatus to the extent that the oxygen content in the vent gas was less than 0.5 mol %, and then hydrogen gas having a purity of 96 mol % was used to replace to the extent that the hydrogen content in the discharged gas was greater than 90 mol %. Hydrogen gas was filled to the extent that the reforming high-pressure separator had a pressure of 350 KPa. The circulation of the reforming compressor was initiated so that the recycle gas amount reaches to $5\times10^4 Nm^3/h$. After each reactor was increased to the reactor inlet temperature of 200° C. at a rate of 20-40° C. per hour, dimethyl disulfide was injected into the recycle gas and temperature thereof continued to be increased. The injection of dimethyl disulfide enabled the sulfur amount in the recycle gas to be $3\text{-}5\times10^{-6}$ L/L. When the reactor inlet temperature was increased to 370° C., such temperature was maintained for 3 h. Then sulfur injection discontinued, and hydrogen gas having a purity of 96 mol % was used to replace the gas in the system so as to reduce the sulfur amount in the recycle gas to less than $2\times10^{-6}$ L/L. The reforming reaction materials were then re-fed therein for the reforming reaction, wherein the reforming feedstock had the following components as listed in Table 1, and the reaction conditions and results were listed in Table 2. When the catalyst was sampled during the operation, carbon block was not found. After the reactor was shut down and overhauled, coking was not found at high-temperature positions.

Comparative Example 1

The reforming catalyst was fed into the continuous reforming apparatus, wherein the catalyst had the same composition as that in Example 1.

Figure 2:
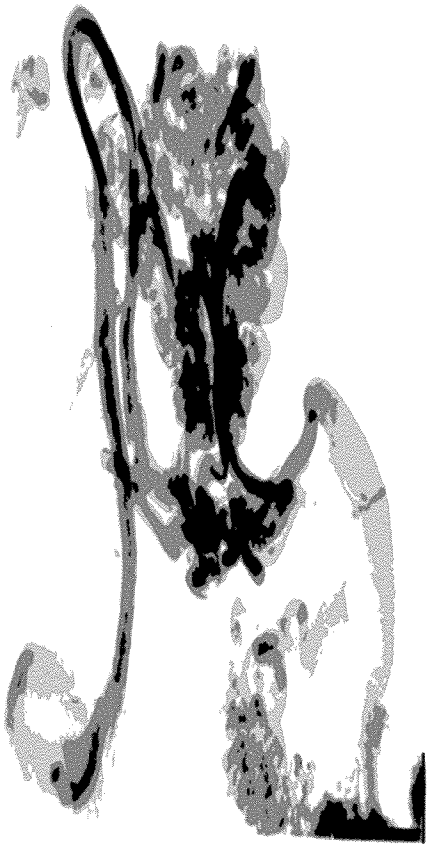
Figure 3:
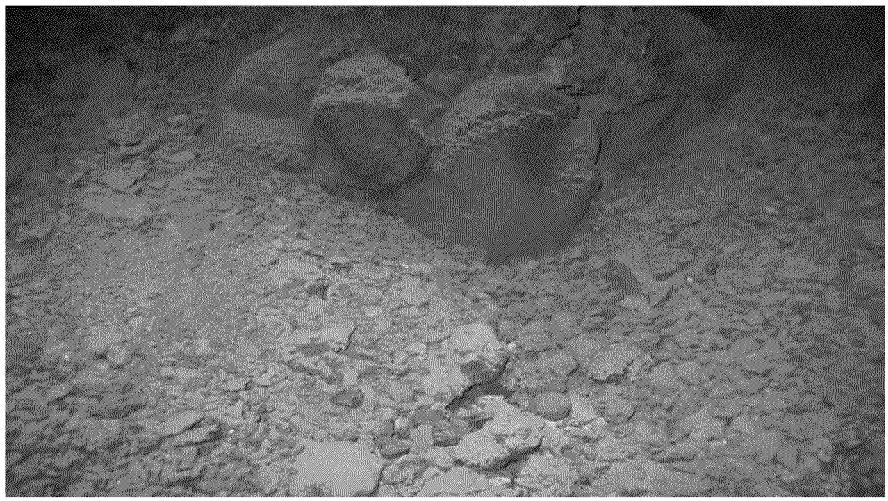
FIG. 3 is the photograph of coking at the bottom of the reactor in Comparative Example 1.

Nitrogen gas having a purity of 99.8 mol % was used to replace to the extent that the oxygen content in the discharged gas was less than 0.5 mol %, and then hydrogen gas having a purity of 93 mol % was used to replace to the extent that the hydrogen content in the discharged gas was greater than 60 mol %. Hydrogen gas was filled to the extent that the reforming high-pressure separator had a pressure of 350 KPa. The circulation of the reforming compressor was initiated so that the recycle gas amount reaches to $4\times10^4 Nm^3/h$. After each reactor was increased to the reactor inlet temperature of 370° C. at a rate of 20-40° C. per hour, the reforming feedstock having the components as listed in Table 1 was fed into the reforming reactor. After reforming-feeding, dimethyl disulfide was injected into the feedstock so that sulfur amount in the feedstock reached to 0.2-0.3 μg/g. Then the reaction was carried out under the conditions of the normal reforming operation, wherein the main operating conditions and reaction results were listed in Table 2. After the operation of the reforming apparatus for 3 months, the catalyst sample was collected at the disengaging hopper, and carbon block having a size of 1-5 mm was usually discovered. The electronic microscope photographs of carbon block samples were respectively shown in FIG. 1 and FIG. 2, which showed that carbon block was fibrous carbon with iron particles at the top thereof. After the apparatus was shut down and checked, it was found that the reactor had notable coking at the bottom thereof (see FIG. 3).

TABLE 1

| Group composition | Exp. 1 | Com. Exp. 1 |
|---|---|---|
| Paraffin, mass % | 52.18 | 52.66 |
| Naphthene, mass % | 42.06 | 40.52 |

TABLE 1-continued

| Group composition | Exp. 1 | Com. Exp. 1 |
|---|---|---|
| Aromatics, mass % | 5.76 | 6.82 |
| Aromatics potential, mass % | 43.80 | 44.67 |
| ASTMD86 distillation range, ° C. | 84~176 | 81~172 |
| Total sulfur amount, μg/g | <0.5 | <0.5 |

TABLE 2

| Item | Exp. 1 | Com. Exp. 1 |
|---|---|---|
| Hydrogen/feedstock oil molar ratio | 1.96 | 2.0 |
| liquid hourly space velocity, hr-1 | 1.41 | 1.44 |
| Catalyst circulating rate, % | 100 | 100 |
| First reactor inlet temperature/temperature drop, ° C. | 528/143 | 526/147 |
| Second reactor inlet temperature/temperature drop, ° C. | 528/89 | 526/88 |
| Third reactor inlet temperature/temperature drop, ° C. | 528/64 | 526/66 |
| Fourth reactor inlet temperature/temperature drop, ° C. | 528/52 | 526/50 |
| Total temperature drop, ° C. | 348 | 351 |
| Pure hydrogen yield, mass % | 3.77 | 3.65 |
| Stabilized gasoline octane number (RONC) | 102.7 | 102.5 |

Comparative Example 2

The reaction system of the continuous reforming apparatus was controlled to have an average pressure of 0.45 MPa, and a gas-liquid separator pressure of 0.34 MPa. The catalysts in the reaction system were in an amount of 50060 kg, comprising 0.28 mass % of platinum, 0.31 mass % of tin, and 1.10 mass % of chlorine. Naphtha listed in Table 3 was used as the feedstock.

After air-tight seal of hydrogen gas in the system was checked and qualified, the hydrogen circulation was initiated. The temperature of the reaction system was increased at a rate of 40-50° C. per hour. After each reactor reached to a temperature of 370° C., the reforming feedstock was fed in a feeding amount of 57 t/hour. Meanwhile, the reactor was increased to 480° C. at a rate of 20-30° C./hour. While the temperature was increased, dimethyl disulfide was injected into the reaction materials and the sulfur amount in the reforming feedstock was controlled to be 0.3-0.5 μg/g. When the feedstock was fed, tetrachloroethylene was injected into the feedstock according to the water content in the recycle gas.

Figure 4:
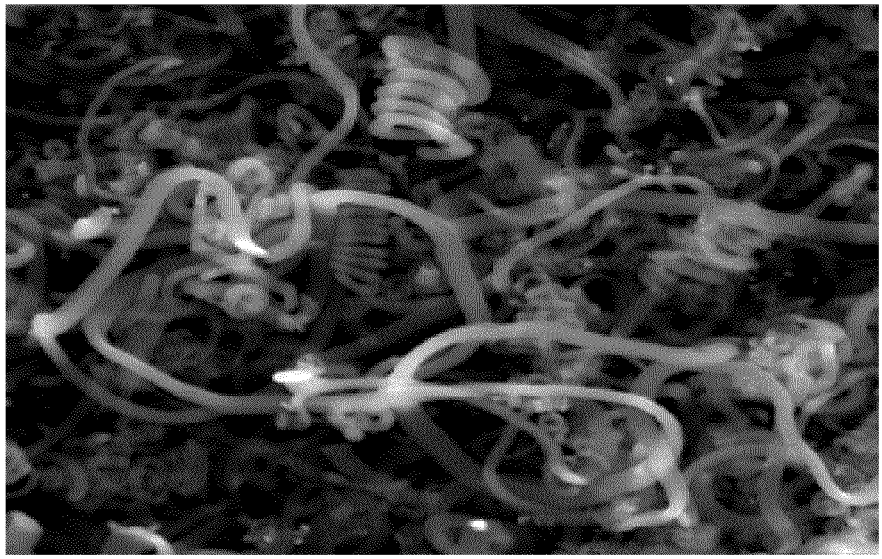
FIG. 4 is the electronic microscope photograph of the coking sample in Comparative Example 2, which is the fibrous carbon with iron particles at the top thereof.

When the water content of the reforming recycle gas was less than 200 μL/L, the reactor was increased to 490° C. and dehydrated at such temperature. While dehydration was carried out, the chlorine-injecting amount was gradually decreased according to the water content in the recycle gas. When the water content in the recycle gas was less than 50 μL/L, the feeding amount was gradually increased to 95 t/hour, and the inlet temperature of each reforming reactor was increased to 530° C. After the feedstock was fed for 96 h, the catalyst regeneration system was initiated. After the catalyst regeneration system was normally operated, the chlorine injection of the feedstock discontinued. The main operating conditions and reaction results of each reactor were listed in Table 4. During the operation of such apparatus in 6 months, the reaction system and the regeneration system were normally operated without any blockage of the regeneration system. When the catalyst sample was collected at the disengaging hopper, a small amount of carbon blocks having a size of 1-5 mm were usually discovered. The electronic microscope photographs showed that they were still fibrous carbon as shown in FIG. 4. After the apparatus was normally shut down and checked, it was found that there was still a small amount of coke on the reactor walls. However, the severe metal-catalyzed coking was not discovered in the reactor and heating furnace.

Example 2

The continuous reforming apparatus in Comparative Example 2 was normally shut down and checked, and the catalyst was unloaded. The inner of the reactor was cleaned. By sieving and gravitational settling, a small amount of carbon granules were separated from the catalyst and re-fed into the catalyst for production. The reforming feedstocks and catalyst in Comparative Example 2 were used therein. After air-tight seal of hydrogen gas in the system was checked and qualified, the hydrogen circulation was initiated. The temperature of the reaction system was increased at a rate of 40-50° C. per hour. After each reactor reached to a temperature of 370° C., the reforming feedstock was fed in a feeding amount of 57 t/hour. Meanwhile, the reactor was increased to 480° C. at a rate of 20-30° C./hour. While the temperature was increased, dimethyl disulfide and tetrachloroethylene were injected into the reforming feedstock and the sulfur amount in the reforming feedstock was controlled to be 6.0 μg/g. After sulfide was injected into the feedstocks, the concentration of hydrogen sulfide in the reforming recycle gas was analyzed every two hours. When the concentration of hydrogen sulfide in the recycle gas reached to 2 μL/L, the amount of sulfide to be injected was reduced to sulfur amount of 0.2-0.5 μg/g in the reforming feedstock. When the water content of the reforming recycle gas was less than 200 μL/L, the reactor was increased to 490° C. and dehydrated at such temperature. While dehydration was carried out, the chlorine-injecting amount was gradually decreased according to the water content in the recycle gas. When the water content in the recycle gas was less than 50 μL/L, and hydrogen sulfide in the recycle gas had a concentration of less than 2 μL/L, the reforming feeding amount was gradually increased to 95 t/hour, and the inlet temperature of each reforming reactor was increased to 530° C. After the feedstock was fed for 96 h, the catalyst regeneration system was initiated. After the catalyst regeneration system was normally operated, the chlorine injection of the feedstock came to a halt and the normal reforming operation was carried out. The main operating conditions and reaction results of each reactor were listed in Table 4.

Example 3

According to the process as disclosed in Example 2, the continuous reforming apparatus was normally shut down and checked, and the catalyst was unloaded. The reaction started after the catalyst was fed, wherein the difference lay in the sulfur injection amount of 1.0 μg/g into the reforming reaction materials after the feedstocks were fed into the reforming reaction apparatus. After normal operation, the main operation conditions and reaction results of various reactors were listed in Table 4.

Example 4

According to the process as stated in Example 2, the continuous reforming apparatus was normally shut down and checked, and the catalyst was unloaded. After the catalyst was loaded, the reaction was initiated. The difference lay in that organic sulfide was not fed into the feedstock after the feedstocks were fed into the reforming reaction apparatus, and the reforming pre-hydrogenation tail gas was introduced into the reforming system at a rate of 500-550 $Nm^3/h$, wherein said tail gas had a sulfur amount of 550 μL/L and a hydrogen purity of 94%. The ratio of sulfur introduced into the system to the reforming feedstock into the system was 4 μg/g. When hydrogen sulfide concentration in the recycle gas of the reforming apparatus reached to 2 μL/L, the pre-hydrogenation tail gas was introduced at a rate of 30-40 $Nm^3/h$. That is to say, the ratio of the total sulfur amount introduced into the system to the reforming feedstock was reduced to a ratio of 0.3-0.5 μg/g. When the water content of the reforming recycle gas was less than 200 μL/L, the reactor was increased to 490° C. and dehydrated at such temperature. While dehydration was carried out, the chlorine-injecting amount was gradually decreased according to the water content in the recycle gas. When the water content in the recycle gas was less than 50 μL/L, and hydrogen sulfide in the recycle gas had a concentration of less than 2 μL/L, the reforming feeding amount was gradually increased to 95 t/hour, and the inlet temperature of each reforming reactor was increased to 530° C. After the feedstock was fed for 96 h, the catalyst regeneration system was initiated. After the catalyst regeneration system was normally operated, the chlorine injection of the feedstock came to a halt and the normal reforming operation was carried out. After normal operation, the main operating conditions and reaction results of each reactor were listed in Table 4.

As compared with the reaction results in Comparative Example 2, the reaction activity of the catalyst in the process of the present invention was not affected by the high sulfur amount in the feedstock during the initial reaction. During the operation of 1 year after the apparatus was put into production, the reaction and regeneration system normally operated. When the catalyst sample was collected at the disengaging hopper, the carbon block in the form of fibrous carbon was not discovered. Moreover, the metal-catalyzed coking was not discovered in the reactor and heating furnace.

TABLE 3

| | | |
|---|---|---|
| Group composition, mass % | Paraffin | 49.78 |
| | Naphthene | 41.94 |
| | Aromatics | 8.24 |
| ASTM D86 distillation range, ° C. | 851~63 | |
| Total sulfur amount, μg/g | <0.2 | |

TABLE 4

| Item | Exp. 2 | Exp. 3 | Exp. 4 | Com. Exp. 2 |
|---|---|---|---|---|
| Feeding rate, t/h | 95 | 95 | 95 | 95 |
| Hydrogen/feedstock molar ratio | 2.0 | 2.0 | 2.0 | 1.98 |
| liquid hourly space velocity, $hr^{-1}$ | 1.44 | 1.44 | 1.44 | 1.44 |
| Catalyst circulating rate, % | 100 | 100 | 100 | 100 |
| First reactor inlet temperature/temperature drop, ° C. | 530/140 | 530/140 | 530/138 | 530/139 |
| Second reactor inlet temperature/temperature drop, ° C. | 530/85 | 530/86 | 530/88 | 530/87 |
| Third reactor inlet temperature/temperature drop, ° C. | 530/66 | 530/67 | 530/67 | 530/65 |
| Fourth reactor inlet temperature/temperature drop, ° C. | 530/46 | 530/45 | 530/46 | 530/47 |
| Total temperature drop, ° C. | 337 | 338 | 336 | 338 |
| Pure hydrogen yield, mass % | 3.70 | 3.72 | 3.71 | 3.71 |
| Stabilized gasoline octane number (RONC) | 103.0 | 103.2 | 103.1 | 103.3 |

The invention claimed is:

1. A pre-passivation process for a continuous reforming apparatus, said continuous reforming apparatus comprising a reactor, said process comprising loading a reforming catalyst into the continuous reforming apparatus, starting a gas circulation, said gas circulation including a recycle gas, and raising the temperature of the reactor, injecting sulfide into the gas circulation at a reactor temperature ranging from 100-650° C., controlling the sulfur amount in the recycle gas within a range of $3\text{-}20\times10^{-6}$ L/L so as to passivate the continuing reforming apparatus.

2. The process according to claim 1, characterized in that the injected sulfide is hydrogen sulfide when the recycle gas is an inert gas.

3. The process according to claim 2, characterized in that the inert gas is nitrogen gas.

4. The process according to claim 1, characterized in that, after the passivation is finished, a purge gas is firstly introduced to replace the gas circulation in the apparatus; when the content of hydrogen sulfide in the recycle gas leaving from the outlet of the reactor is not greater than $5\times10^{-6}$ L/L, the feedstock is fed for normal reforming reaction operation, wherein the purge gas is hydrogen gas, inert gas or a mixture of inert gas and hydrogen gas.

5. The process according to claim 1, characterized in that the recycle gas is hydrogen gas, inert gas or a mixture of inert gas and hydrogen gas.

6. The process according to claim 1, characterized in that the sulfide is hydrogen sulfide, carbon bisulfide, dimethyl disulfide, a sulfur-containing aliphatic compound, a sulfur-containing alicyclic compound, a sulfur-containing aromatic compound, a thiophene compound, a morpholine compound or a mixture of two or more of said compounds.

7. The process according to claim 1, characterized in that the catalyst comprises a support, 0.05-1.0 mass % of a platinum-group metal, 0.05-1.0 mass % of tin and 0.1-5.0 mass % of halogen, based on the dry basis support.

8. The process according to claim 7, characterized in that, in the reforming catalyst, the platinum-group metal is platinum; the halogen is chlorine; and the support is alumina.

9. A passivation process for a continuous reforming apparatus during the initial reaction, said continuous reforming apparatus comprising a reaction system, said reaction system having more than one reactor including a reforming reactor, said process comprising (1) loading a reforming catalyst into the continuous reforming apparatus, starting a gas circulation, said gas circulation including a recycle gas, and raising the temperature of a reactor in said reaction system, feeding a reforming feedstock into the reaction system when the temperature of the reactor is increased to 300-460° C., introducing sulfide into the reaction system while or after the reforming feedstock is fed, controlling the ratio of the total sulfur amount introduced into the reaction system to the reforming feedstock within the range of 0.5 μg/g-50 μg/g, reducing the content of sulfide introduced into the reaction system when hydrogen sulfide concentration in the recycle gas reaches 2.0 μL/L~30 μL/L; and (2) maintaining the reforming reactor at a temperature of 460-490° C., controlling the ratio of the total sulfur amount introduced into the reaction system to the reforming feedstock within the range of 0.2 μg/g-0.5 μg/g when the water content in the recycle gas is less than 50 μL/L, adjusting the amount of the reforming feedstock to the design value of the continuous reforming apparatus, increasing the reforming reactor temperature to 490-545° C. according to the requirements on the octane number of the liquid product, and letting the continuous reforming apparatus run under normal operating conditions.

10. The process according to claim 9, characterized in that sulfide is introduced into the reaction system in the manner of adding sulfide into the reforming feedstock.

11. The process according to claim 9, characterized in that sulfide is introduced into the reaction system in the manner of adding hydrogen sulfide or a hydrogen sulfide-containing gas into the recycle gas.

12. The process according to claim 11, characterized in that the hydrogen sulfide-containing gas is a hydrogen-containing gas having a hydrogen sulfide content of 50-5000 μL/L.

13. The process according to claim 9, characterized in that sulfide is introduced into the reaction system in the manner of adding hydrogen sulfide or a hydrogen sulfide-containing gas into the recycle gas and adding sulfide into the reforming feedstock.

14. The process according to claim 9, characterized in that the reforming feedstock introduced in step (1) is in an amount of 50-75 mass % of the designed feed rate of the reforming apparatus.

15. The process according to claim 9, characterized in that the sulfide initially introduced in step (1) should enable the ratio of the total sulfur amount introduced into the system to the reforming feedstock to be 0.6-20 μg/g.

16. The process according to claim 9, characterized in that, when the concentration of hydrogen sulfide in the recycle gas reaches to 2.0-4.0 μL/L, the ratio of the total sulfur amount introduced into the system to the reforming feedstock is controlled to be 0.2~0.5 μg/g.

17. The process according to claim 9, characterized in that, after the ratio of the total sulfur amount introduced into the system to the reforming feedstock in step (1) is reduced to 0.2~2.0 μg/g, a regeneration system is started for the cyclic regeneration of the catalyst when the hydrogen sulfide in the recycle gas is in a concentration of less than 5.0 μL/L.

18. The process according to claim 9, characterized in that the recycle gas is hydrogen gas, inert gas or a mixture of inert gas and hydrogen gas.

19. The process according to claim 18, characterized in that the inert gas is nitrogen gas.

20. The process according to claim 9, characterized in that the sulfide is hydrogen sulfide, carbon bisulfide, dimethyl disulfide, a sulfur-containing aliphatic compound, a sulfur-containing alicyclic compound, a sulfur-containing aromatic compound, a thiophene compound, a morpholine compound or a mixture of two or more of said compounds.

21. The process according to claim 9, characterized in that the catalyst comprises a support, 0.05-1.0 mass % of a platinum-group metal, 0.05-1.0 mass % of tin and 0.1-5.0 mass % of halogen, based on the dry basis support.

22. The process according to claim 21, characterized in that, in the reforming catalyst, the platinum-group metal is platinum; the halogen is chlorine; and the support is alumina.

* * * * *